US006960995B2

(12) United States Patent
Parker et al.

(10) Patent No.: US 6,960,995 B2
(45) Date of Patent: Nov. 1, 2005

(54) INTEGRATED LIGHTNING DETECTOR

(75) Inventors: James Parker, Thornhill (CA); Reinhart K. Pildner, Brampton (CA)

(73) Assignee: Tyco Safety Products Canada Ltd., Concord (CA)

( * ) Notice: Subject to any disclaimer, the term of this patent is extended or adjusted under 35 U.S.C. 154(b) by 0 days.

(21) Appl. No.: 10/600,369

(22) Filed: Jun. 23, 2003

(65) Prior Publication Data

US 2004/0257216 A1 Dec. 23, 2004

(30) Foreign Application Priority Data

Feb. 7, 2003 (CA) ..... 2 418 673

(51) Int. Cl.[7] ..... G08B 25/00

(52) U.S. Cl. ..... 340/525; 340/507; 340/601; 700/79; 324/72

(58) Field of Search ..... 340/525, 601, 340/507, 508, 511, 512, 536, 638, 650, 651, 652, 659; 700/21, 79; 324/72

(56) References Cited

U.S. PATENT DOCUMENTS 3,781,859 A * 12/1973 Hermans ..... 340/507
4,206,451 A * 6/1980 Kurschner ..... 340/522
4,442,514 A * 4/1984 Roth ..... 367/136
5,291,208 A 3/1994 Young
5,920,259 A 7/1999 Shpater
5,959,815 A 9/1999 Gilbert
5,977,762 A 11/1999 Murtha, Jr. et al.
6,134,303 A * 10/2000 Chen ..... 379/49

* cited by examiner

*Primary Examiner*—Daniel Wu

(57) ABSTRACT

An alarm panel of a security system is additionally provided with an interference circuit for evaluating the possible presence of a large electromagnetic interference signal such as lightning. The earth ground connection of the alarm panel to a power source is used to provide an input to the interference circuit. The earth ground connection receives large transient signals caused by such naturally occurring events. The alarm panel uses this additional information to modify the reporting of alarm conditions. This has particular application for addressing problems associated with motion detectors falsely triggering when a large electromagnetic signal is received. The solution of the alarm panel sensing this condition in contrast to each detector sensing this condition is more reliable, allows combining of detector information and is more cost effective.

20 Claims, 3 Drawing Sheets

Example of input signal on GND-ERH terminal

Example of output on LIGHTNING_DET terminal

INTEGRATED LIGHTNING DETECTOR

FIELD OF THE INVENTION

The present invention relates to security systems, and in particular, to alarm panels and the determination and processing of signals and the subsequent reporting to a security station.

BACKGROUND OF THE INVENTION

It is now common for businesses and homeowners to have a security system for reporting of alarm conditions to a security station. One of the primary functions of such a security system is to provide an alarm report to the security station when the owner is absent and one or more of the detectors reports an alarm condition. The type of detectors vary from relatively simple hard wired detectors, such as door or window contacts, to more sophisticated battery operated sensors such as motion and glass break detectors.

The security alarm system located in the premise being protected includes a series of different types of sensors all of which report to an alarm control panel. The control panel is typically installed in a safe location and is directly connected to the power supply. The alarm control panel is connected either by hardwires to the individual sensors or communicates or receives signals from individual detectors as part of a wireless communication. The communication between the alarm panel and the sensors can be a one way communication where the detectors merely transmit to the alarm panel or can be two way communication.

It is known that certain natural events can cause some sensors, in particular motion sensors and glass breakage sensors to falsely trigger. Lightning produces a broadband electromagnetic signal which produces a signal in the detector or causes a change in the monitored space leading to a false activation of the detector. Thunder associated with lightning can also cause a large acoustic signal which can lead to false alarms. Lightning and thunder are two examples of naturally occurring events which produce high energy which can lead to false alarms in security detectors.

The occurrence of false alarms is a major concern to the security industry. As can be appreciated, naturally occurring events such as lightning typically do not affect a single alarm system but affect a number of alarm systems in a certain proximity to the natural occurring event. The alarm panels report to the security system the detection of an alarm condition which is then processed by the security station. Processing of each false alarm incurs a certain expense but more importantly, it also reduces the confidence that a reported alarm condition is in fact an alarm condition which requires prompt investigation.

To overcome the above problems, some motion detectors have been provided with additional circuitry for detecting a naturally occurring event such as lightning. U.S. Pat. No. 5,920,259 discloses a motion detector unit having additional circuitry for detecting the occurrence of lightning. Basically, the detector circuitry acts as a receiver and produces a signal of a magnitude to the sensor when exposed to the electromagnetic signal caused by lightning. To overcome this problem, each detector is provided with redundant circuitry which is also affected by this electromagnetic interference. By subtracting the signal from the motion sensor circuitry from the signal of the redundant circuit, the effect of the electromagnetic signal is eliminated or reduced.

Unfortunately, this arrangement requires each motion detector to include additional redundant circuitry and additional processing of the signals from the two different circuits. This significantly adds to the cost of each sensor, thereby increasing the cost of the overall system.

U.S. Pat. No. 5,977,762 discloses a lightning detector suitable for protection of electronic equipment in a home. The detector receives an electromagnetic signal, through an antennae and applies signal conditioning to produce a series of pulses corresponding to peaks in the signal above a specified threshold. The pulse data is compared with a predetermined criteria that distinguishes lightning produced interference from other electrical interference.

It has been recognized that certain natural occurring events produce electromagnetic interference or radio frequency interference which negatively affect the performance of motion detectors and security systems.

There remains a need to provide a cost effective solution for reducing or modifying the processing of signals from an alarm system when such interference is detected.

SUMMARY OF THE INVENTION

An alarm control panel according to the present invention comprises a signal processing arrangement, an alarm signal receiving arrangement providing received alarm signals to said signal processing arrangement, and a detecting circuit responsive to the presence of naturally occurring transient signals and providing to said processing arrangement a caution signal when a transient signal is detected.

The processing arrangement uses the receipt of an alarm signal and any caution signal in the processing of each received alarm signal.

According to an aspect of the invention, the processing arrangement includes timing means for determining whether the receipt of an alarm signal is associated with the receipt of a caution signal.

According to a further aspect of the invention, the processing arrangement processes each alarm signal by communicating with a remote monitoring station and reporting the receipt of the alarm signal and any associated caution signal.

In a further aspect of the invention, the processing arrangement, upon receipt of an alarm signal without receipt of a caution signal, reports the alarm signal to a remote monitoring station; and wherein processing arrangement, upon receipt of an alarm signal and a caution signal, ignores the step of reporting the received alarm signal to said remote security station.

In a preferred aspect of the invention, the processing arrangement includes a selectable means for choosing a first option or a second option for processing received alarm signals and associated caution signals. According to the first option the processing arrangement reports alarm signals together with any associated caution signals to a remote security monitoring station. According to the second option the processing arrangement ignores the step of reporting of received alarm signals having associated caution signals as alarm signals to the remote security station.

An alarm control panel according to an aspect of the present invention comprises a signal processing arrangement, an alarm signal receiving arrangement providing received alarm signals to the signal processing arrangement, a detecting circuit responsive to the presence of naturally occurring transient signals in an operating environment associated with said control panel and providing to the processing arrangement a caution signal when a transient signal is detected, and wherein the processing arrangement reports received alarm signals with any caution signals to a remote monitoring station.

An alarm control panel for a security system according to an aspect of the present invention includes a communication arrangement for communicating and receiving alarm conditions from a series of security detectors, a processing arrangement which processes the signals from the security detectors and based thereon determines when an alarm condition exists. The alarm control panel further includes a circuit for detecting the presence of transient electromagnetic signals of a magnitude likely to cause some of the security detectors to falsely produce a signal indicative of an alarm condition. The processing arrangement modifies the processing of detector determined conditions when the circuit arrangement detects the presence of such a transient electromagnetic signal.

An alarm control panel according to a preferred aspect of the invention, is operable in one of two different modes. In the first mode, the alarm control panel continues to report all alarm conditions from detectors in a conventional manner and additionally reports the detection of the transient electromagnetic signal when present. With this arrangement, a security station has additional information and can make a decision with respect to how to respond to the receipt of an alarm condition, as well as a possible source of the alarm condition which may not require investigation.

The second mode of the alarm control panel temporarily interrupts the reporting of alarm conditions when the circuit arrangement detects the presence of such a transient electromagnetic signal.

A method of reducing false alarms in a security alarm systems having an alarm panel which processes signals received from a series of detectors includes the steps of using a receiving circuit of the alarm control panel to detect an electromagnetic signal indicative of lightning and upon detection of an electromagnetic signal indicative of lightning, interrupting normal operation of the security alarm system by temporarily ignoring any signals received from the series of remote sensors, or reporting together with a detected alarm condition, the detection of an electromagnetic signal indicative of lightning.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
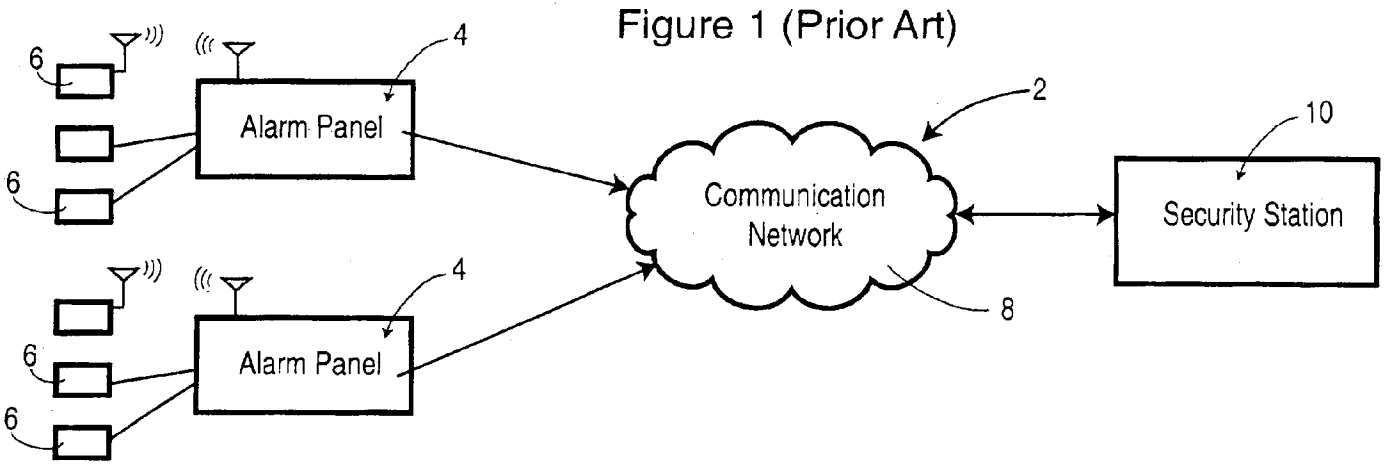
Figure 1 (Prior Art)
FIG. 1 is a schematic view of an alarm control system and the reporting thereof to a security station.

The schematic view of FIG. 1 shows two alarm panels 4 communicating through a network 8 such as the cellular telephone network or public switched telephone network with the security station 10. Each of the alarm panels 4 has a series of detectors 6 which provide information to the alarm panel regarding the status of the monitored space. The detectors 6 can include, for example, different types of motion detectors, glass break detectors, and contact switches. These types of detectors can be hard wired to the alarm panel 4 or can communicate with the alarm panel by wireless communication.

In wireless communication, typically the wireless detector 6 will transmit alarm information or status signal to the alarm panel on a predetermined basis. For cost reasons, the wireless communication is typically not a two way communication. There are a host of security systems which operate in the manner of FIG. 1.

The individual detectors 6 can be sensitive to electromagnetic interference, radio frequency interference and other energy sources. Motion detectors and in particular motion detectors which operate based on passive infrared radiation, can falsely produce an alarm signal when lightning may be present. Lightning produces a broadband electromagnetic signal which falsely triggers the motion detector. Glass break detectors typically operate by monitoring signal strength and comparing the signal with a broadband signal typical of a glass break event. Electromagnetic interference can similarly trigger a glass break detector. Other naturally occurring signals include thunder which can also produce sympathetic vibration signals.

Motion detectors are highly sensitive to detect changes in the monitored space, however, this sensitivity renders the detectors more vulnerable to false alarms caused by naturally occurring interference.

Figure 2:
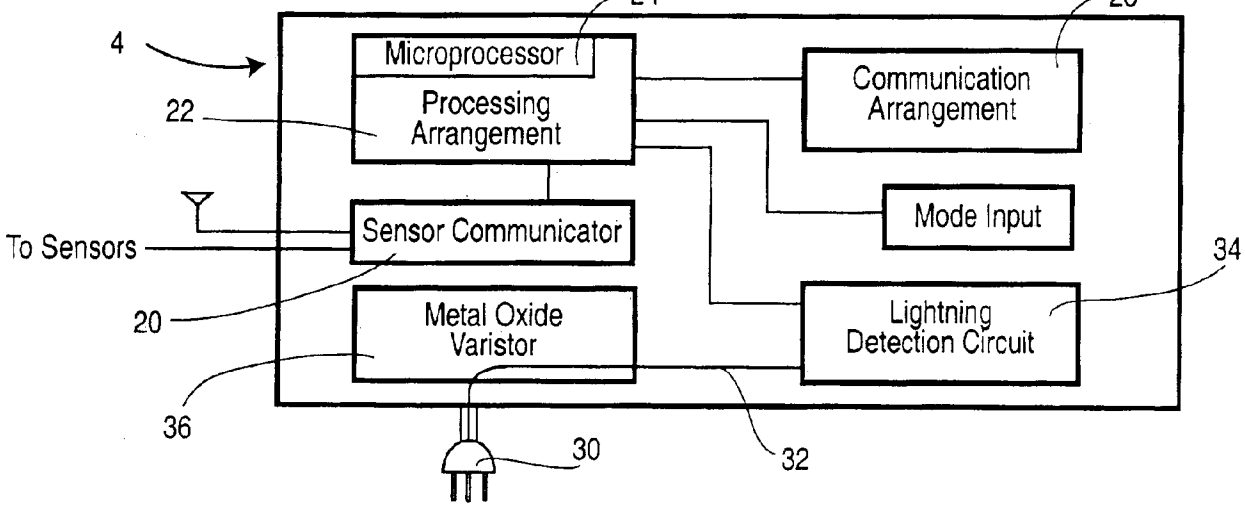
FIG. 2 is a schematic overview of an alarm control panel which receives various signals from detectors.

The alarm panel 4 shown in FIG. 2, includes a detector communication arrangement 20 which is a wireless or wired communication with the individual detectors 6. The detector communication arrangement 20 provides detector information to the processing arrangement 22. This processing arrangement has a microprocessor 24 capable of performing calculations and signal analysis. The processing arrangement 22 also includes information from the lightning detection circuit 34. This lightning detection circuit processes the signals provided to it from the earth ground provided through the electrical plug connection 30. Based on various information provided to the processing arrangement 22, a determination is made whether an alarm condition is to be reported to the security station or whether additional energy detection information is also to be reported. If such an alarm condition is to be communicated, the processing arrangement 22 activates the communication arrangement 26 which receives the alarm information and the panel identification information and communicates the information to the security station 10.

In addition, the alarm panel includes a device 36 for protecting the alarm panel against large transients. Typically this device includes a metal oxide varistor.

With the arrangement as shown in FIGS. 1 and 2, the alarm panels 4 include their own lightning detection circuit 34 and the processing arrangement 22 performs various calculations using the required microprocessor 24 for determining what alarm conditions should be reported. With this arrangement, any of the detectors 6 which may be prone to false alarms due to lightning or other transmitted interference, may falsely report an alarm condition to the alarm panel 4. The alarm panel 4 will determine whether this alarm condition should be reported or should be reported with additional energy detection information which can be provided, in this case, by the lightning detection circuit 34. If the alarm panel senses a lightning signal or other high energy signals, the detectors 6 that may be prone to false alarms due to lightning interference, may report alarm conditions. These alarm conditions, together with the caution signal indicating that lightning has been detected, can be reported by the alarm panels 4 to the security station 10. The security station 10 can then decide whether or not this should be considered an alarm condition requiring investigation. The processing arrangement 22 includes a time function which is used as part of the determination whether the receipt of an alarm signal is associated with a caution signal.

It can also be appreciated that the processing arrangement 22 can provide information with respect to a number of sensors which are reporting alarm conditions. For example, the detectors 6 are often spread throughout a house or office and these detectors will include a number of motion detectors which may be prone to false alarms caused by lightning. If a number of these detectors report an alarm condition at the same time to the alarm panel, and the alarm panel additionally determines via the lightning detection circuit 34 that a lightning interference signal has been received, this provides the processing arrangement 22 with further evidence that the reported alarm conditions may be false alarms. The processing arrangement 22 can also examine the type of output provided by the lightning detection circuit. The lightning detection circuit outputs a pulse when a signal has been received on the earth ground connection of certain strength. Lightning interference will typically be a random event and thus, the likelihood of a repeating pattern of pulses from the lightning detection circuit is unlikely. In contrast, if a jamming signal is being produced to cause the detectors to go into an alarm state, the jamming signal will typically be of a repeating or non random nature. Thus the lightning detection circuit 34, although it will receive the jamming signal, it will produce pulses in a non random manner. This can provide the processing arrangement 22 with further information for possibly identifying a jamming signal and additionally transmitting this information to the security station.

Figure 3:
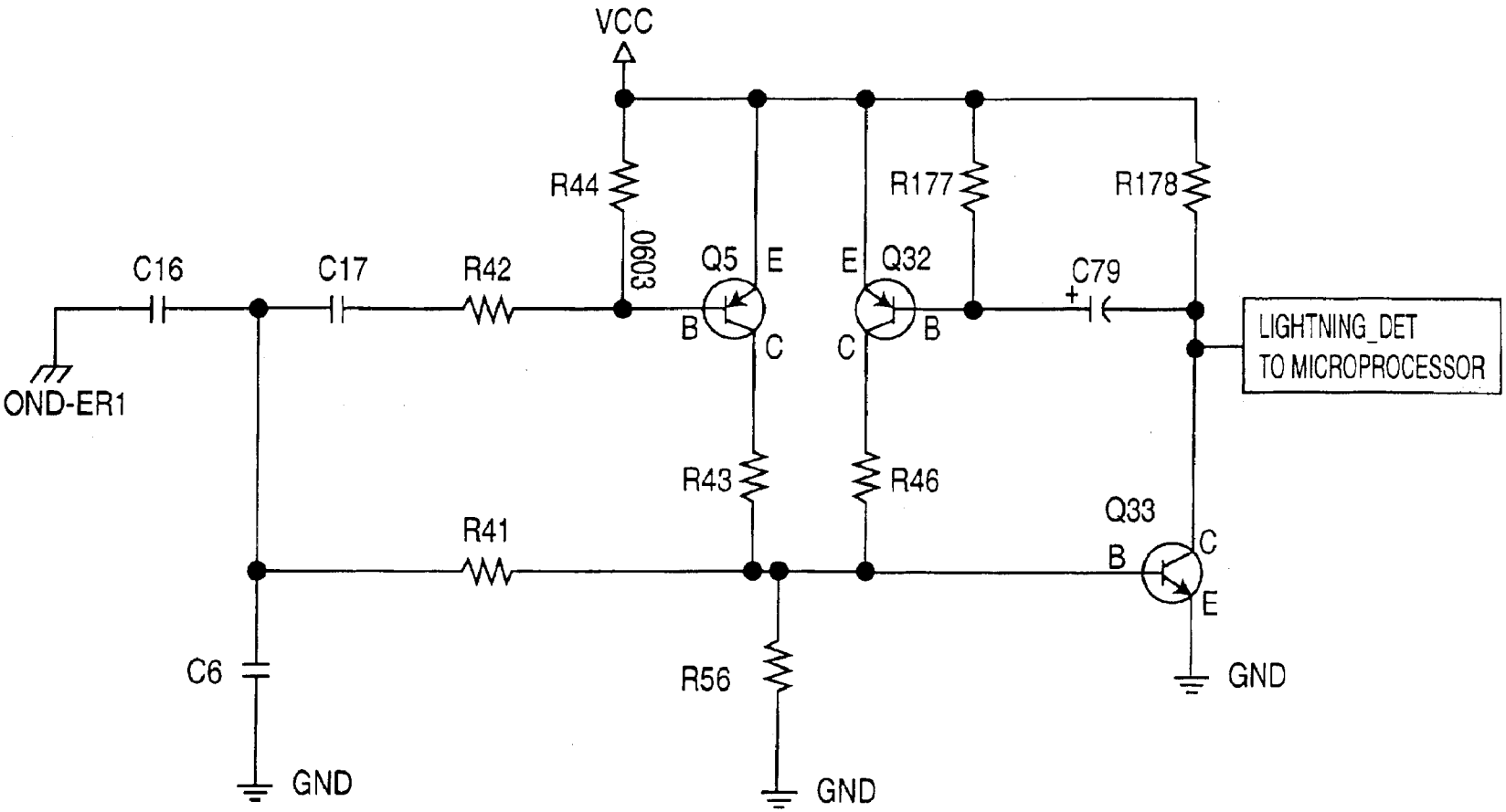
FIG. 3 is a circuit diagram of a circuit used to produce a signal that a transient electromagnetic interference signal has been detected.

The lightning detection circuit is shown in detail in FIG. 3. The circuit is relatively inexpensive to add to the alarm panel and existing components of the alarm panel are used to process the output from the circuit. In particular, the microprocessor 24 receives the lightning detection signal and can modify the reporting of alarm conditions in one of two preferred modes. The modification of the procedure for reporting alarm events requires a change in software and as such, is relatively inexpensive for retrofit applications and is insignificant in new installations. The first reporting mode merely reports the alarm condition but additionally includes information that the lightning detection circuit 34 has indicated the presence of a large energy signal. The second mode is to disregard or interrupt the communication of an alarm signal received from a motion detector or other detector which is prone to lightning interference, when the lightning circuit has detected the presence of a large energy signal. In this way, the number of communications to the security station are reduced. The alarm panel can include the software for reporting of signals in either mode and an installer or owner can select the appropriate signal processing mode. The selection can be implemented in many ways including, for example, a manual switch or code entry at the keypad or alarm panel.

This second mode has additional risks in that all alarm events are not reported to the security station. This mode can be selected by the installer based on the particular jurisdiction or specific circumstances of the system. In some jurisdictions it is a requirement to report all alarm conditions and as such, the first mode will be selected. The security station 10 will also receive the additional information that the lightning detection circuit has detected the presence of a large interference signal.

With this system, the security station, when the panels are operating in the first mode, will have additional information to determine how to respond to the report of an alarm condition. Furthermore, the information from other panels in the same general area may assist the security station in assessing whether the false alarm is based on the presence of a naturally occurring interference signal. If several alarm panels in the same general area all report that a lightning like interference signal has been received, this provides additional confidence that the sensed signal is a naturally occurring signal and not the result of a jamming interference signal. Furthermore, the processing arrangement 22 can report when the lightning detection circuit 34 is receiving a repeating signal which might be considered a jamming signal. This can be reported even if an alarm condition signal is not received from any of the detectors. This additional information can allow the security station to alert the homeowner that his system has been exposed to a new or significant interference signal which may warrant investigation.

The circuit reacts to both positive and negative voltage spikes that are a minimum of 1000V in amplitude and up to 30 $\mu$S in duration. The signal source or detection point is the EGND (earth ground) terminal on the PCB, which must be connected to an appropriate earth ground in accordance with local codes and standards. The output of the circuit is the collector of Q33, which supplies a negative going pulse to the microcontroller. The functional description of the circuit is broken down into two main blocks, the positive transient and the negative transient.

The positive voltage spike appears on the earth ground and is AC coupled through C16. The signal is attenuated by the capacitive divider setup by the C16 and. C6 and applied to the base of Q33 through R41. Since the spike has positive polarity Q5 will remain off. However, if the input spike at the EGND was sufficient (>1000V) Q33 will turn on pulling the input to the microcontroller low. At the same time Q32 is turned on allowing current to flow through R46 to the base of Q33 therefore holding Q33 on until C79 charges up enough to turn Q32 off. This will hold the microcontroller input low for approximately 800 mS so that it can be debounced and processed.

The negative voltage spike appears on the earth ground and is AC coupled through C16. The signal is then attenuated by the capacitive divider setup by C16 and C6 and applied to the base of Q5 through C17 and R42. If the input spike at the EGND was sufficient (≈−1000V) Q5 will turn on allowing current to flow through R43 to the base of Q33 turning it on which pulls the input to the microcontroller low. At the same time Q32 is turned on allowing current to flow through R46 to the base of Q33 therefore holding Q33 on until C79 charges up enough to turn Q32 off. This will hold the microcontroller input low for approximately 800 mS so that it can be debounced and processed.

Figure 4:
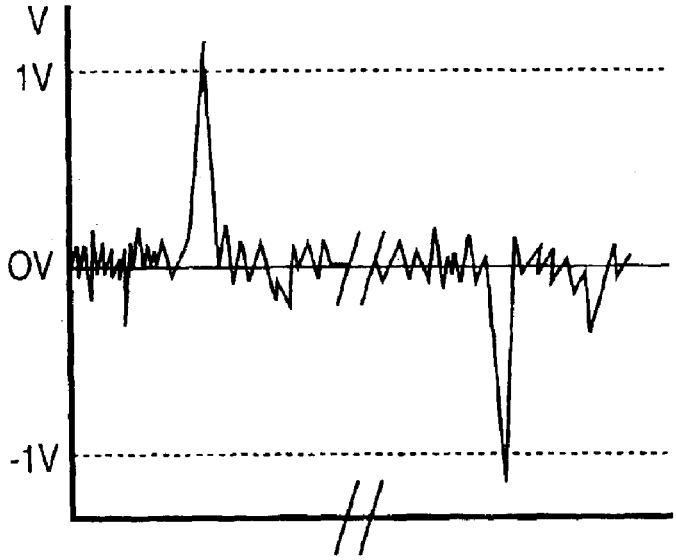
FIG. 4 is an example of the signal on the ground circuit used for detection of electromagnetic interference.

FIG. 4 shows an example of the type of signal that is present on the ground to earth terminal of the alarm panel 4. This signal, due to the circuitry, has been reduced, however, in the presence of lightning produced interference, both positive and negative large transients can occur. In this case there are large positive transients followed by large negative transients.

Figure 5:
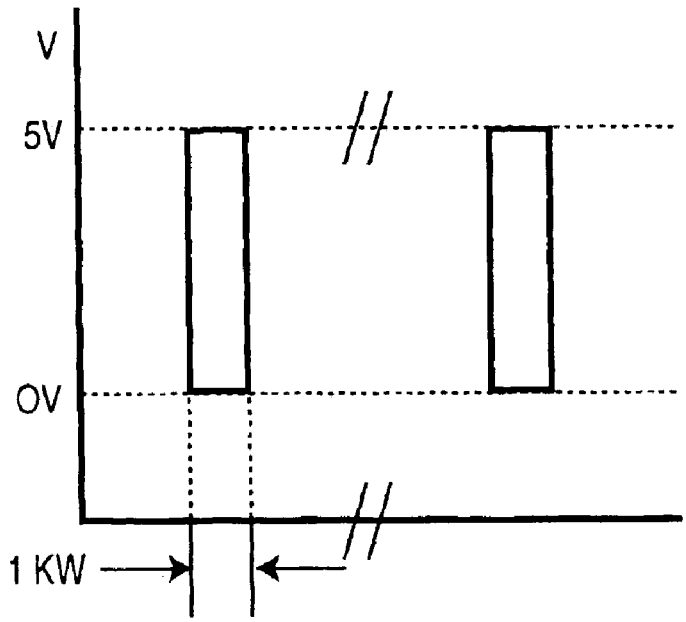
FIG. 5 is a possible output of the circuit to produce a signal indicative of the detection of such electromagnetic interference.

In FIG. 5 it is shown that the output of the lightning detection circuit is typically five volts unless a large transient is detected. In this case, both the positive and the negative large transients cause the output to drop to zero volts for a short period of time determined by the circuit. Thus the output of the circuit is normally at five volts and drops to zero volts when a large transient is detected.

The modification of the alarm panel has been described with respect to a circuit suitable for detecting of lightning or other large electromagnetic interference signals.

With the present design, false alarms are assessed by the control panel as opposed to having each detector conduct its own self assessment of potential alarm conditions. By providing the detection circuit as part of the control panel, economies of scale are realized and the control panel is provided with information from the group of detectors such that a more informed decision can be made. For example, a large interference signal is likely to cause a number of known detectors to false report an alarm condition. Detectors of the same type can be provided in the same zone to simplify the processing of information and can be compared with detectors in other zones which are not sensitive to this type of condition. For example, motion detectors can be in certain zones and other detectors such as contacts can be in a different zone.

It is also possible for the alarm control panel to process the information from the lightning detection circuit for other potential alarm conditions. For example, a jamming interference signal can be recognized by comparing the output from the lightning detection circuit with a predetermined pattern or can be analysed for particular characteristics thereof. Therefore, this circuit, which is built into the control panel also provides further information with respect to the environment being monitored. It can be appreciated that the addition of further detectors are easily accommodated and any detectors which are prone to false alarms can be placed in appropriate zones.

Preferably, the alarm control panel allows the installer to set a programmable time, perhaps in the order of six seconds, which is the time period that the alarm control panel may ignore alarm conditions reported from the detectors when the lightning detection circuit determines the presence of a large signal. It is also possible for the alarm panel to include a series of profiles, for example, a lightning profile and a thunder profile, for potentially matching or recognizing these types of events from other interference signals. Although the lightning detection circuit has been described specifically with respect to lightning, this circuit basically recognizes signals which are received by the alarm control panel which could affect the operation of the system.

Although the circuit detects the broadband electromagnetic signal of lightning and other large transient signals, this signal can also be used for modifying the behavior of other detectors, such as an acoustic detector. An acoustic detector is basically processing sound signals and can falsely report an alarm condition caused by thunder. The thunder acoustic signal will be received a certain time delay after the broadband electromagnetic signal of the lightning is received. Therefore, the system can include a certain time delay or window for potentially modifying the reporting of alarm conditions associated with acoustic detectors.

The modification of the operation of the alarm control panel has been specifically described with respect to reporting to the security station. It is also possible to modify the operation of the system in other ways. For example, the alarm control panel can suppress the local sounder while still providing the alarm station with an alarm signal. It also possible to modify the type of sound produced such that an alarm condition which would normally produce a large buzzer sound is modified to a unique tone sound when an alarm condition and a large transient signal has been detected by the detection circuit. This arrangement may be preferred where the premise is occupied but some zones are armed (perimeter zones). In these circumstances, automatic reporting to the security station could be cancelled or delayed awaiting a user clear signal (user code). If the user code is not received, the alarm condition could be reported.

The circuit shown in FIG. 3 can also be modified to have an adjustable threshold. The adjustable threshold can be set according to the particular area in which the alarm system will operate. Some areas have under normal operation, significant interference signals. Possible false alarms can still be reported, however, these can be reported with the information that a significant interference has been detected.

This arrangement is also appropriate for dealing with certain problem installations. False alarms can be analysed relative to alarm panel sensed conditions to identify problem detectors. Such detectors can be replaced or the reporting of sensed alarm conditions modified based on the alarm panel assessment of the operating environment. Potential alarm conditions from such detectors may require multiple sensed alarms to produce a reported alarm condition or perhaps an alarm condition from a different detector. Detected alarm conditions out of synchronization with the alarm panel might also be used to decide to report the alarm. Thus, the alarm panel provides additional information to allow the reporting to the security station to be modified.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An alarm control panel for a security system, said alarm control panel including a communication arrangement for communicating and receiving alarm signals from a series of security detectors, a processing arrangement which processes the signals received from the security detectors and based thereon determining when an alarm condition exists, said alarm control panel further including a circuit for detecting the presence of transient electromagnetic signals exceeding a magnitude above which some security detectors can falsely produce a signal indicative of an alarm condition, said processing arrangement temporarily interrupting the determination of an alarm condition when said circuit arrangement detects the presence of such a transient electromagnetic signal.

2. An alarm control panel as claimed in claim 1 wherein said processing arrangement includes a timing arrangement that defines a time duration during which identification alarm conditions are not processed.

3. An alarm control panel as claimed in claim 1 wherein said processing arrangement includes additional logic for determining when sensed transient electromagnetic signals are of a repetition or duration not normally associated with naturally occurring transient electromagnetic signals and based thereon determines an alarm condition exists.

4. An alarm control panel as claimed in claim 1 wherein said circuit arrangement detects the presence of a transient electromagnetic signal by detecting transient voltages between earth ground and circuit ground.

5. An alarm control panel as claimed in claim 1 wherein said processing arrangement upon detecting the presence of a transient electromagnetic signal ignores for a predetermined time period received security detector signals.

6. An alarm control panel as claimed in claim 1 wherein said circuit arrangement compares a signal produced by a first circuit branch designed to be responsive to received transient electromagnetic signals and a second circuit branch designed to identify transient electromagnetic signals on an earth ground of said alarm control panel.

7. An alarm control panel as claimed in claim 6 wherein said circuit arrangement produces an output signal when both circuit branches detect a transient electromagnetic signal indicative of lightning.

8. In a security alarm system having an alarm panel in combination with a series of security detectors, said alarm control panel including a communication arrangement for communicating and receiving alarm signals from any of said series of security detectors and a processing arrangement which processes the signals received from said security detectors and based thereon determining when an alarm condition exists, said alarm control panel further including a circuit for detecting the presence of transient electromagnetic signals exceeding a magnitude above which some security detectors can falsely produce a signal indicative of an alarm condition, said processing arrangement temporarily interrupting the determination of an alarm condition when said circuit arrangement detects the presence of said transient electromagnetic signal.

9. In a security alarm system as claimed in claim 8 wherein said circuit identifies the presence of electromagnetic signals indicative of lightning.

10. In a security alarm system as claimed in claim 9 wherein said processing arrangement interrupts the determination of an alarm condition by temporarily ignoring the signals received from said security detectors.

11. A method of reducing false alarms in a security alarm system having an alarm panel that processes signals received from a series of remote sensors, said method comprising the steps of using a receiving circuit of said alarm control panel to detect an electromagnetic signal indicative of lightning; and upon detection of an electromagnetic signal indicative of lightning, interrupting normal operation of said security alarm system by temporarily ignoring any signals received from the series of remote sensors.

12. A method as claimed in claim 11 wherein said step of temporarily ignoring any signals received from the series of remote sensors has a predetermined time period whereafter normal operation of said security alarm system continues.

13. A method as claimed in claim 11 wherein said step of detecting an electromagnetic signal indicative of lightning using said alarm control panel includes a comparison of transient voltages associated with earth ground of said alarm control panel and transient voltages associated with a circuit ground of said alarm control panel.

14. A method as claimed in claim 13 including providing in said alarm control panel a circuit which acts as a receiver for detecting transient voltages produced by lightning.

15. An alarm control panel comprising a signal processing arrangement, an alarm signal receiving arrangement in communication with a sensor, for providing received alarm signals to said signal processing arrangement, a detecting circuit responsive to the presence of naturally occurring transient signals and providing to said processing arrangement a caution signal in addition to and independent of said alarm signals when a transient signal is detected, said processing arrangement using the receipt of an alarm signal and any caution signal in the processing of each received alarm signal.

16. An alarm control panel as claimed in claim 15 wherein said processing arrangement includes timing means for determining whether the receipt of an alarm signal is associated with the receipt of a caution signal.

17. An alarm control panel as claimed in claim 16 wherein said processing arrangement processes each alarm signal by communicating with a remote monitoring station and reporting the receipt of the alarm signal and any associated caution signal.

18. An alarm control panel as claimed in claim 15 wherein said processing arrangement, upon receipt of an alarm signal without receipt of a caution signal, reports the alarm signal to a remote monitoring station, and said processing arrangement, upon receipt of an alarm signal and a caution signal, ignores the step of reporting the received alarm signal to said remote security station.

19. An alarm control panel as claimed in claim 16 wherein said processing arrangement includes a selectable means for choosing a first option or a second option for processing received alarm signals and associated caution signals, said first option causing said processing arrangement to report alarm signals together with any associated caution signals to a remote security monitoring station; said second option causing said processing arrangement to ignore the step of reporting of received alarm signals having associated caution signals as alarm signals to said remote security station.

20. An alarm control panel comprising a signal processing arrangement, an alarm signal receiving arrangement in communication with a sensor, for providing received alarm signals to said signal processing arrangement, a detecting circuit responsive to the presence of naturally occurring transient signals in an operating environment associated with said control panel and providing to said processing arrangement a caution signal in addition to and independent of said alarm signals when a transient signal is detected, and wherein said processing arrangement reports received alarm signals with any caution signals to a remote monitoring station.

* * * * *